United States Patent [19]

King et al.

[11] 4,023,063

[45] May 10, 1977

[54] COLOR TUBE HAVING CHANNEL ELECTRON MULTIPLIER AND SCREEN PATTERN OF CONCENTRIC AREAS LUMINESCENT IN DIFFERENT COLORS

[75] Inventors: Hewson Nicholas Graham King; Derek Washington, both of Salfords, near Redhill, England

[73] Assignee: U.S. Philips Corporation, New York, N.Y.

[22] Filed: Apr. 17, 1974

[21] Appl. No.: 461,539

[30] Foreign Application Priority Data

Apr. 19, 1973 United Kingdom ..... 18965/73

[52] U.S. Cl. ..... 313/400; 313/105 CM; 313/95; 313/470

[51] Int. Cl.[2] ..... H01J 31/48; H01J 31/20; H01J 39/18

[58] Field of Search ..... 315/12, 11, 13 C, 31 R, 315/31 TV; 250/213 VT, 213 R; 313/409, 414, 373, 95, 105, 105 CM, 103 CM, 415, 470, 472, 461, 473, 397

[56] References Cited

UNITED STATES PATENTS

| | | | |
|---|---|---|---|
| 2,619,608 | 11/1952 | Rajchman | 313/415 X |
| 2,842,697 | 7/1958 | Bingley | 313/471 |
| 2,962,623 | 11/1960 | Beintema | 313/397 X |
| 3,260,876 | 7/1966 | Manley et al. | 313/400 |
| 3,609,433 | 9/1971 | Freedman | 250/213 VT |
| 3,634,712 | 1/1972 | Orthuber | 315/12 |
| 3,675,028 | 7/1972 | Grant | 315/11 |
| 3,860,849 | 1/1975 | Schagen et al. | 313/400 |

*Primary Examiner*—Robert Segal
*Attorney, Agent, or Firm*—Frank R. Trifari; Ronald L. Drumheller

[57] ABSTRACT

Electron beam apparatus comprising a channel plate which emits electrons in the form of hollow electron beams, a focusing control electrode for controlling the diameter of the hollow beams and a target having a pattern of concentric areas aligned with each hollow beam, said pattern having at least two different areas which respond differently to electron bombardment and may be selectively bombarded under control of said electrode.

3 Claims, 12 Drawing Figures

COLOR TUBE HAVING CHANNEL ELECTRON MULTIPLIER AND SCREEN PATTERN OF CONCENTRIC AREAS LUMINESCENT IN DIFFERENT COLORS

This invention relates to electron multipliers and more particularly to electron multipliers of the channel plate type. The invention can be applied with particular advantage to channel plates used in electronic imaging and display tubes for multi-colour display applications.

In present practice a "channel plate" is a secondary-emissive electron-multiplier device comprising a matrix in the form of a plate having a large number of elongate channels passing through its thickness, said plate having a first conductive layer on its input face and a separate second conductive layer on its output face to act respectively as input and output electrodes.

Secondary-emissive intensifer devices of this character are described, for example, in British Pat. No. 1,064,073 and in U.S. Pat. Nos. 3,260,876, 3,387,137, 3,327,151 and 3,497,759, while methods of manufacture are described in British Pat. Nos. 1,064,072 and 1,064,075.

The channel plates described in these specifications can be regarded as continuous-dynode devices in that the material of the matrix is continuous (though not necessarily uniform) in the direction of thickness or the direction of the channels. In their operation a potential difference is applied between the two electrode layers of the matrix so as to set up an electric field to accelerate the electrons, which field establishes a potential gradient created by current flowing through resistive surfaces formed inside the channels or (if such channel surfaces are absent) through the bulk material of the matrix. As in all channel plates, secondary-emissive multiplication takes place in the channels.

More recently, various modification have been proposed which will be referred to as "laminated" channel plates in contrast with the conventional continuous-dynode type of channel plate. Some of these proposals hark back to an earlier proposal which appeared in 1960 when Burns and Neumann published details of a channel plate made up of a number of perforate metal layers separated from each other by layers of insulator (J. Burns and M. J. Neumann, Advances in Electronics and Electron Physics XII 1960 pages 97 – 111). In this construction and in the more recent modifications the continuous matrix of the conventional channel plate structure is replaced by a stack of perforate conductive sheets or plates which are separated from each other and act as discrete dynodes with aligned apertures providing the channels.

During investigations into such laminated or discrete-dynode channel plates for large-area displays it was discovered that the outgoing electrons were emitted as hollow beams so as to form a pronounced ring on the screen in front of each channel. We have observed this effect also in continuous-dynode channel plates of conventional type and of the type described in Patent Specification No. . . . (co-pending Application 2842/73 - PHB 32307).

It is an object of the present invention to make use of such hollow electron beam formations in such manner as to perform control and selection functions.

The invention provides an electron beam device comprising a channel plate structure of such form as to cause the final electrons to be emitted in hollow beams, a target parallel to the output face of said structure, and a focussing control electrode between said structure and target which electrode has apertures aligned with the channels of said channel plate structure and is provided to vary the overall width of said beams when varying focus potentials are applied thereto, said target having an array of patterns of concentric areas having differing responses to electrons bombardment and each of said patterns being aligned with an aperture of the focussing control electrode in such manner that said varying focus potentials can control the electron beams so as to cause them to land on differing selected areas of said patterns.

According to a further feature of the invention, the device may be one wherein the target is a display screen and wherein each pattern of its array is a multi-colour-phosphor pattern with concentric areas adapted to luminesce in differing colours.

In a preferred arrangement the channel plate structure is a laminated structure of the kind referred to above wherein the dynodes are separated from each other and arranged in cascade with aligned apertures providing the channels. In this case its output dynode has a dominant effect on the form of the hollow beams and said output dynode may be of the kind described and claimed in co-pending U.S. patent application Ser. No. 456,374 filed Mar. 29, 1974. In some of the embodiments described below, a channel plate structure of the laminated type comprises a plurality of such dynodes.

In other examples the laminated structure is replaced by a thin plate of continuous dynode type having flared channels in accordance with Patent Specification (co-pending Application 2842/73 — PHB 32307). If such channels are non-circular in cross-section (for example pyramidal) then the concentric target patterns may also be non-circular. Embodiments of the invention applied to colour display tubes will now be described by way of example with reference to the accompanying diagrammatic drawings wherein:

FIGS. 1 to 5 relate to laminated channel plate structures in accordance with said co-pending U.S. pat. application Ser. No. 456,374.

Figure 1:
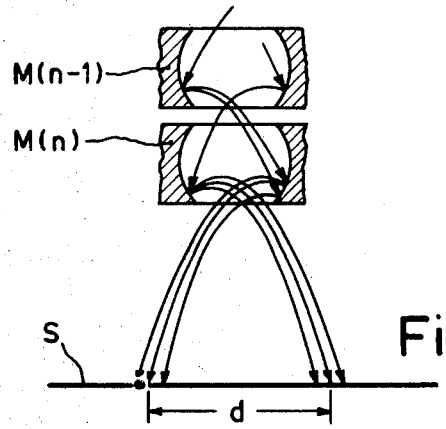

Referring to FIG. 1, the dynode apertures of a channel are shown as having symmetrical configurations which are substantially spherical with input and output diameters equal or approximately equal to each other and to the dynode thickness.

FIG. 1 shows schematically a single aperture of each of the last two discrete dynodes M($n$-1) and M($n$) of a channel plate structure which may have about 10 to 12 stages. As is shown schematically, most of the output electrons cross over so as to form a hollow beam and land on the screen S in such manner as to form a luminous ring having a mean diameter $d$.

In accordance with the present invention, by adding another electrode to act as a focusing control electrode and varying the voltage between it and the final dynode, it is possible to vary the size of this ring and to reduce it to a spot. In the case of FIG. 1 the control electrode can be identical (in form and spacing) with the dynodes M($n$) and M$n$-1), the only difference being the variable focus potential applied to it for control purposes. However, this concave form is not very suitable and there is a risk that some output electrons from dynode M($n$) may be intercepted by the control electrode instead of landing on the screen (for this reason it may in some cases be necessary to reduce the secondary-emissive properties of the control electrode as compared with the dynodes).

Better performance can be obtained with a focus control electrode with apertures of open or flared form e.g. as shown at Mf in FIG. 2. This drawing shows separators D and Df which in this example are of insulating (as opposed to resistive) material. Suitable voltages are, for example, $Vn = 250V$ (constant, $Vs = 4KV$ (also constant) and $Vf = 140V$ as the most positive focusing voltage used when the focus electrode Mf exerts minimum control (this is shown in FIG. 2 ($a$) as an electron ring of large diameter $d1$ on the screen S). If the focus voltage Vf is changed to 60V the electron ring is reduced to a mean diameter $d2$ (FIG. 2($b$) and if $Vf$ is reduced further to OV the electron ring pattern can be closed into a luminous patch or dot of radius $d3$ (FIG. 2($c$)) (it is preferable for the sources Vf and VS to be independent of each other, e.g. as shown, so that colour switching does not affect the screen potential).

Figure 4A:
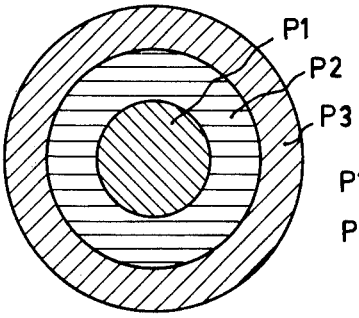
Figure 4B:
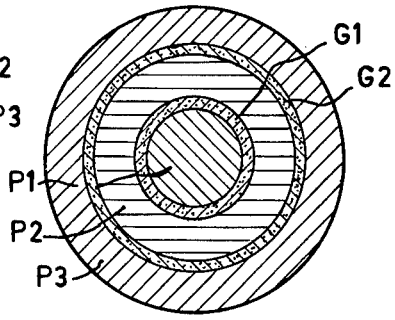

By placing a pattern of concentric phosphor areas of three different colours (the inner colour being a dot e.g. as shown in FIG. 4) in front of each channel, it is possible to change the colour of the display. For example, the electrons in FIG. 2($a$) can be arranged to land on one colour, in FIG. 2($b$) on a second colour and in FIG. 2($c$) on a third colour. The focusing control electrode Mf thus acts as a colour selector electrode.

Figure 3:
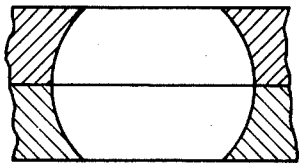

As explained in the aforesaid co-pending U.S. patent application Ser. No. 456,374 it is convenient for each dynode to be made in two sheet-metal halves (see FIG. 3) in which case it is convenient from the point of view of manufacture for the focussing electrode M$f$ to be identical to one of these dynode halves. With such an arrangement the spacing between electrodes Mf and M($n$) may be the same as that between adjacent dynodes (for examples about ⅓ or ¼ of the dynode thickness).

If the latter proportions are adopted, the actual dimensions may, for example, be as follows:

TABLE

| | | |
|---|---|---|
| Dynode thickness | = 0.3 | mm |
| Spacer (D) thickness | = 0.1 | mm |
| Input diameter of holes | = 0.3 | mm |
| Output diameter of holes | = 0.3 | mm |
| Thickness of Mf electrode | = 0.15 | mm |
| Distance from Mf to Screen | = 4.0 | mm |
| Channel pitch (distance between axes of adjacent channels) | = 0.75 | mm |

The voltage values given previously by way of illustration can be used with a structure having this set of dimensions.

The arrangement of FIG. 2 is not adequate for selection of three colours in cases where a high degree of colour purity is required, one reason being that the dark centre of the largest electron ring is smaller than the diameter of the smallest electron spot. On the other hand, the structure shown can be adequate for two-colour displays (e.g. for radar) or for tri-colour displays of data in which a high degree of colour saturation is not required.

Colour separation (and hence colour saturation) can be improved by providing non-luminescent guard-rings between concentric phosphor areas. This is illustrated in FIG. 4 which contrasts a simple 3-colour phosphor pattern of circular form (FIG. 4$a$) with a similar pattern having guard rings G1 and G2 between the three phosphors P1-P2-P3.

The capacitance between the focus electrode and dynode M($n$) can be reduced by increasing the transparency of Mf and the distance between it and dynode M($n$), and for some applications it is possible to obtain sufficient reduction to allow switching at dot frequency. However, for cathode-ray colour television display tubes of large diameter the capacitance of the tri-colour switching system as shown in FIG. 2 may in practical cases preclude switching at dot-sequential-frequency in accordance with incoming PAL, NTSC or like signals. However, use of the system can be made possible by displaying the colour information line sequentially rather than simultaneously or dot-sequentially. Known proposals for line-sequential display suffer the disadvantage that either the bandwidth occupied by the transmitter signals has to be increased to permit a higher line frequency for the same definition or else viewing is disturbed by so-called colour flicker or colour creep effects. In particular it is possible, according to the simplest approach, to present each line in only one colour, and adopt a straight forward red-green-blue colour sequence for successive lines, thus discarding the video information in the other two colours for each line. However, apart from the loss of information, it is well known from earlier similar experiments, aimed at reducing the bandwidth of the colour signals, that such a display system gives rise to an unacceptable amount of apparent colour creep or 'line-crawl'.

However, U.S. Pat. No. 1331938 (copending Application No. 18191/73 — (PHB 32021A) provides improved display circuitry whereby colour information can be presented line-sequentially without requiring an increase in line frequency, and consequently in bandwidth, to avoid the appearance of colour creep or colour flicker, and substantially without losss of video information. This is achieved by displaying 3 red lines (1 actual and 2 stored), then 3 green lines, then 3 blue lines and so forth. In the case of a single-gun tube, this can be done by applying spot-wobble methods as described in the said Specification.

The present invention has particular advantages in applications requiring large-area viewing screens, for example radar and television display C.R.T. applications and large-area image intensifiers. Thus in C.R.T. application the input dynode is scanned by an electron beam whereas in image-intensifier applications the input electrons are provided by a photo-cathode. The latter may be located near the input dynode or may be in the form of photo-emissive surface areas on the input electrode as described for example in U.S. Pat. No. 3,327,151 or in British Pat. No. 1,303,889.

Reverting to details of tube and channel plate construction, the tube of FIG. 2 may (apart from the added focus electrode Mf, layer Df and the special target S) have features and variants as described in the aforesaid co-pending U.S. Application 456,374. In particular, the structure includes preferably an input dynode which has an aperture form which is tapered instead of being concave and opens out in the direction of incoming electrons.

Figure 5:
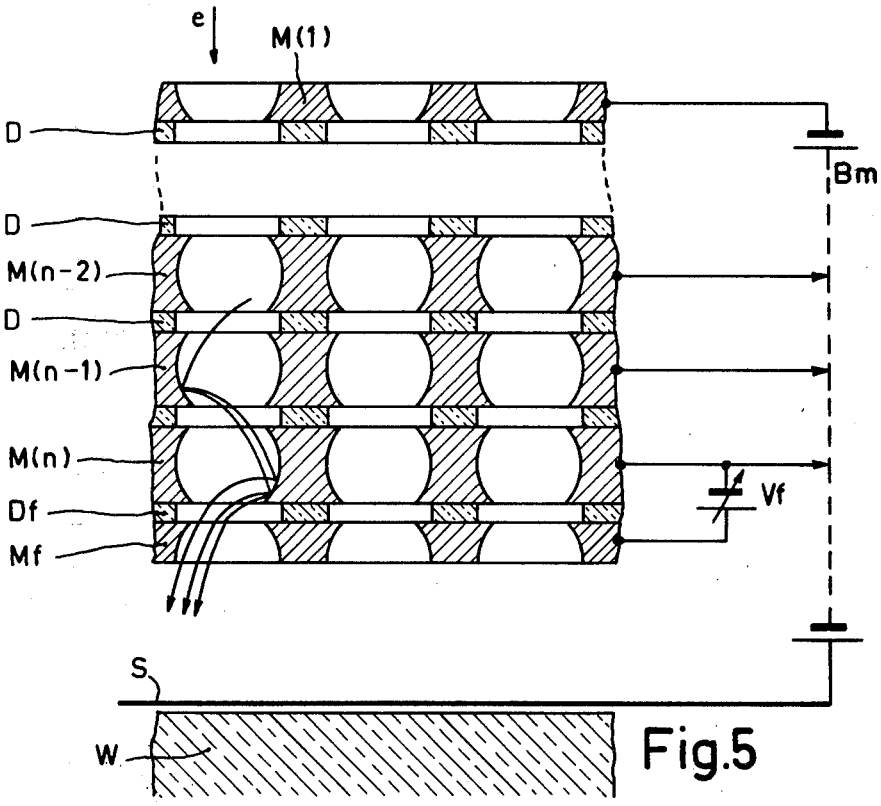

Such an input dynode is used in a more detailed example which is shown in FIG. 5 where the apertures of the input electrode (M(1)) open out to receive incoming electrons *e* from a photo-cathode or a scanning electron beam, and the target is a phosphor screen S provided (with a conductive layer) on a plate W which may be a window forming part of the envelope of the tube. The dynodes may be made up as pairs of half-plates in accordance with FIG. 3, in which case the input dynode M(1) and focus electode Mf may each be made from such a half-plate. The D.C. supplies for the laminated channel plate and target S are indicated generically as a multiple source Bm while the variable control electrode source is shown again schematically as a unit Vf.

Although described as having continuous separator layers D of insulating material, the assemblies of FIGS. 2 and 5 may have layers D of resistive material as described in Patent Specification No. . . . (co-pending Application 53371/71 — PHB 32212) and/or said layers may be discontinuous e.g. in the form of arrays of lines or dots as described in Patent Specification No. . . . (co-pending Application 59966/71 — PHB 32220). The same applies to the layer Df with the proviso that the choice of a resistive material (or resistive coating of its exposed surfaces) will increase the power required to drive the focus control electrode Mf.

Figure 6:
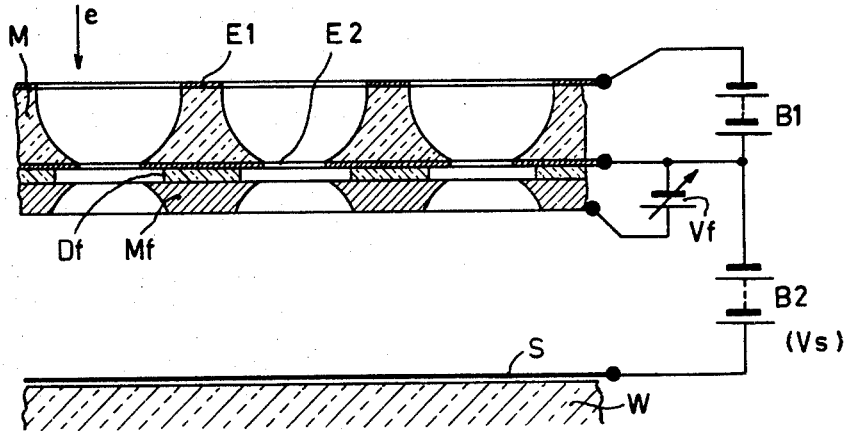
FIG. 6 shows an arrangement employing a thin channel plate having flared channels in accordance with the said Patent Specification No. . . . (co-pending Application 2842/72 — PHB 32307)

The arrangement shown in FIG. 6 has a thin matrix M which may be an apertured sheet of glass having resistive (i.e. slightly conductive) secondary-emissive multiplier surfaces formed on the flared walls of its channels.

An input electrode E1 is formed on the input face of the plate and an output electrode E2 on its output face.

A display screen is shown at S on a transparent support W which may be a window forming part of the envelope.

The screen S includes a conductive layer and appropriate potentials are applied to elements E1, E2 and S by HT sources shown schematically at B1–B2.

In addition, a grid (not shown) may be provided on and in contact with electrode E1 in order to improve the field configuration inside the channels as described in the aforesaid Patent Specification No. . . . (Application 2842/73 — PHB 32307).

As in the case of FIG. 5, the input electrons *e* may be derived from a photo-cathode in the case of an image intensifier tube or from a scanning beam in the case of a C.R.T. application. The considerations which apply to the focus electrode M*f* and its control voltage Vf are also similar to those which apply to the arrangement of FIG. 5.

In the examples described above, and in general, the target and the output face of the channel plate do not have to be planar so long as they are parallel to each other in the sense of having uniform or substantially uniform mutual separation. For example, they may both be slightly curved to conform with the shape of a curved face-plate of the envelope of the tube.

As for the form of the target, each pattern need only be concentric and aligned with a channel in the sense that the areas of the pattern that are liable to be struck effectively by the respective electron beam should be concentric with the centre of the electron beam. Thus in the examples of FIG. 4 the outer phosphor area P3 can, of course, merge with all the adjacent P3 areas so that the P3 phosphor occupies an unbroken area of grid form extending across the whole target, but the operative P3 areas will still be annular and concentric with the P2 and P1 areas. This is illustrated by a two-colour example shown in FIG. 7 where dots of a first phosphor P1 are surrounded by an uninterrupted area of a second phosphor P2 (the operative areas of P2 are indicated by dotted circles).

Figure 8:
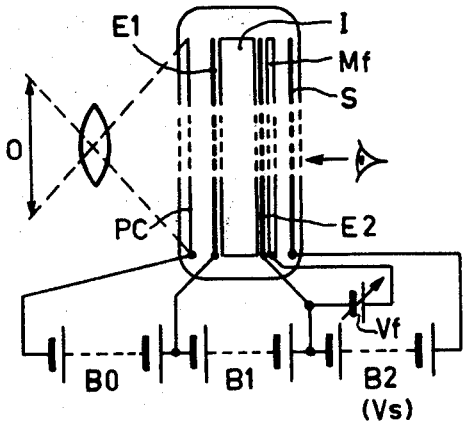
FIGS. 8 and 9 show imaging tube constructions.

FIG. 8 shows schematically an image intensifier of the "proximity" type which may be used, for example, to display cyclically (in two or three colours) X-ray images obtained with X-rays of cylcically varied hardness. Alternatively, the input may be light of visible wavelengths, in which case an object O can be imaged on to the photo-cathode (PC) by optical means.

The channel plate according to the present invention is shown at I and may be as described with reference to FIG. 6, in which case its input and output electrodes are fed by a source shown, again, schematically at B1. A suitable P.D. is applied between elements PC and E1 by a source Bo, and a source B2 applies an accelerating P.D. between E2 and a multi-colour display screen S comprising a conductive layer.

The colour of the display is changed by changing the P.D. Vf which is applied as a stepped waveform between E2 and the focus electrode Mf. This can readily be done at a frequency sufficient to produce the effect of a multi-colour image by the persistence of vision of the human eye.

As an alternative, the channel plate I of FIG. 8 may be as described with reference to FIG. 5, in which case sources B1 – B2 correspond to the source Bm of that example.

Figure 9:
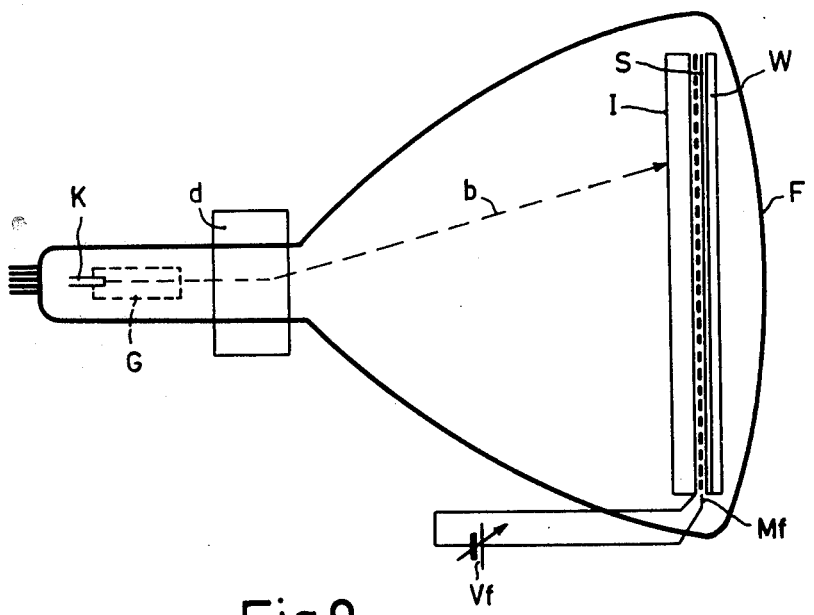

FIG. 9 shows schematically a cathode-ray tube having an electron gun G (with cathode K) for generating a beam *b* which is deflected by deflection means *d* so as to scan the input face of a channel plate I. The latter may, again, be as described with reference to FIG. 5 or FIG. 6 and therefore the details of its structure and power supplies will not be repeated. A multi-colour display screen S is provided, as before, on a support W which may be a separate glass plate or the face-plate of the tube. The focus electrode is shown at Mf.

If the tube of FIG. 9 is used for tri-colour television display, the line-sequential system referred to above (British Pat. No. 1,331,938) may be adopted, in which case the source Vf will be switched at a colour-switching rate corresponding to the line frequency while deflection means *d* will include (assuming a single beam) means for applying a spot-wobble component to the scanning motion of the beam *b* (in this case the focus control voltage Vf will have a stepped waveform in which each of the three voltage levels is maintained for a duration corresponding substantially to one line period).

A colour display tube such as the tube described with reference to FIG. 9 has the advantages generally found in single-gun colour tubes, for example the absence of convergence problems. It has also an additional advantage in that the scanning function is completely divorced from the colour-selection function (this is in marked contrast with the indexing or Apple type of single-gun tube). For this reason it is possible to employ scanning modes other than the normal T.V. raster mode, for example pseudo-random scans as required, for example, when the tube is to be used for alphanumeric data displays.

As in the case of said copending U.S. patent application Ser. No. 456,374 the apertures of successive conductor layers such as those of FIGS. 2 and 5 have to be aligned with sufficient accuracy to form uninterrupted channels through the channel plate structure, but such alignment does not imply that the channels are necessarily straight and normal to the input and output faces of the channel plate. In fact, as is explained and illustrated in the said Specification, successive conductor layers may be deliberately displaced with respect to each other so as to enable their apertures to form channels which are not straight and/or not normal to the channel plate faces.

Figures 2A, 2B, 2C:
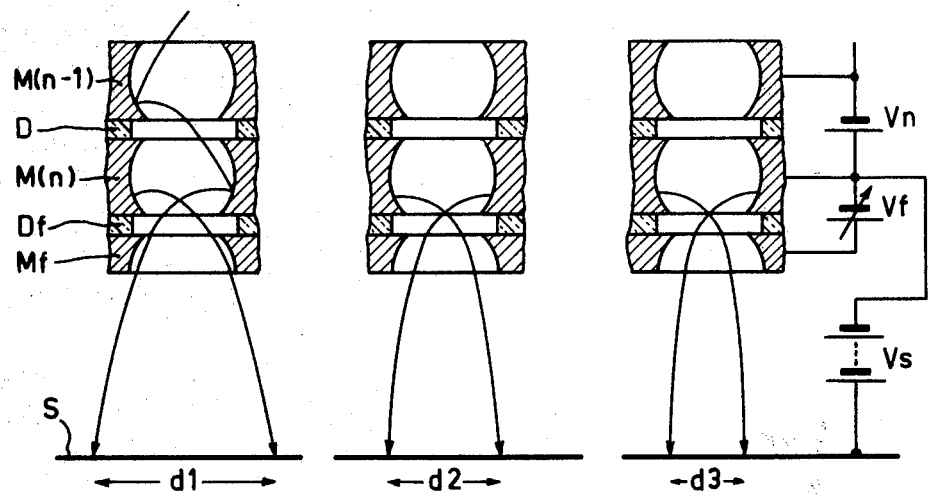
Figure 7:
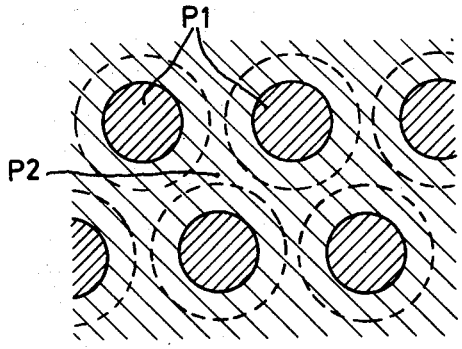
FIG. 7 shows an alternative target pattern array.

In the examples described with reference to FIGS. 2, 4 and 7 the hollow electron beams can be constricted by the action of the focus electrode until they cease to be hollow (at least at the screen) and thus form, on the screen, continuous spots as opposed to rings (see FIG. 2*c*). This, however, is not essential to the invention and there may be circumstances in which it is desirable to operate with target patterns having for example, two concentric phosphor rings without a central phosphor dot. If the two phosphors are red and green (e.g. in a data display application) a third colour (yellow) can be obtained by focussing each hollow beam to an intermediate width where it excites parts of both phosphor rings.

What is claimed is:

1. Electron beam apparatus, comprising:

a channel plate electron multiplier having an array of channels connecting an input face to an output face, the individual electron beams from the channels of which are substantially in the form of hollow beams;

a target spaced from and parallel to the output face of said channel plate, said target having a concentric pattern of areas corresponding to and aligned with each of said channels, each pattern comprising at least two concentric areas which luminesce in different colors in response to electron bombardment and are spaced by a concentric guard ring area which does not luminesce in response to electron bombardment;

a focusing control electrode between said channel plate and said target having an aperture for a hollow electron beam aligned with each of said channels, said focussing control electrode having an outward flare at least on the side towards said target; and means for applying suitable electric potentials to said focusing control electrode to control the diameter of the hollow beams so that electron bombardment of said target may be directed primarily onto either one of said at least two concentric areas having different responses to electron bombardment.

2. Apparatus as claimed in claim 1 and further comprising a photo-cathode covering the input face of said channel plate.

3. Apparatus as claimed in claim 1 and further comprising an electron gun for directing a scanning electron beam onto the input face of said channel plate.

* * * * *

UNITED STATES PATENT AND TRADEMARK OFFICE

CERTIFICATE OF CORRECTION

PATENT NO. : 4,023,063

DATED : May 10, 1977

INVENTOR(S) : HEWSON NICHOLAS GRAHAM KING ET AL

It is certified that error appears in the above-identified patent and that said Letters Patent are hereby corrected as shown below:

Column 2, line 37, "Embodiments of the invention" should begin a new paragraph line 68, "Mn-1)" should be --M(n-1)--

Column 4, line 36, "U.S." should be -- British --

Signed and Sealed this

*second* Day of *August 1977*

[SEAL]

*Attest:*

RUTH C. MASON
*Attesting Officer*

C. MARSHALL DANN
*Commissioner of Patents and Trademarks*